United States Patent [19]

Kang

[11] Patent Number: 4,909,437

[45] Date of Patent: Mar. 20, 1990

[54] TELESCOPING STRAW ASSEMBLY FOR DRINKING BEVERAGES

[76] Inventor: Charles S. Kang, 5020 Woodman Ave., No. 5, Sherman Oaks, Calif. 91423

[21] Appl. No.: 211,698

[22] Filed: Jun. 27, 1988

Related U.S. Application Data

[63] Continuation-in-part of Ser. No. 113,011, Oct. 26, 1987, abandoned.

[51] Int. Cl.[4] ..... A47G 21/18

[52] U.S. Cl. ..... 239/33

[58] Field of Search ..... 239/33, 289, 302

[56] References Cited

U.S. PATENT DOCUMENTS

| | | | |
|---|---|---|---|
| 942,306 | 12/1909 | Clarke | 239/33 |
| 2,066,121 | 12/1936 | Morris | 239/33 X |
| 2,815,981 | 12/1957 | Nonnamaker et al. | 239/33 |
| 3,776,458 | 12/1973 | Chunga, Sr. | 239/33 |
| 3,946,895 | 3/1976 | Pugh | 220/269 |
| 4,448,316 | 5/1984 | Hiroshige | 239/33 X |

FOREIGN PATENT DOCUMENTS

| | | | |
|---|---|---|---|
| 172395 | 2/1986 | European Pat. Off. | 239/33 |
| 779947 | 1/1935 | France | 239/33 |
| 904010 | 8/1962 | United Kingdom | 239/33 |

*Primary Examiner*—Andres Kashnikow

[57] ABSTRACT

A telescoping straw assembly includes an inner straw resiliently biased within an outer straw. The assembly may be placed within a container so that upon opening the container the inner straw extends beyond the container opening to become available for drinking.

5 Claims, 2 Drawing Sheets

TELESCOPING STRAW ASSEMBLY FOR DRINKING BEVERAGES

CROSS REFERENCE TO RELATED APPLICATION

This application is a continuation-in-part of application Ser. No. 07/113,011 filed Oct. 26, 1987 by Charles S. Kang and now abandoned.

BACKGROUND OF THE INVENTION

This invention relates in general to new and useful improvements in a novel telescoping straw assembly which is stored in the beverage container after the completion of a bottling process and more particularly relates to a novel telescoping straw assembly comprising inner and outer straws and a coil spring associated therewith.

This invention relates to a novel telescoping straw assembly which is particularly adapted for use in the dispensing of beverages which are packed in glass or plastic bottles or possibly in cans. It is to be understood that these beverage containers represent conventional glass and plastic beverage bottles or cans.

U.S. Pat. No. 3,946,895 to Pugh entitled "Container Lid With Tear-Out Closure And Straw" teaches a container having a straw which is deployable through a container opening after the container is opened. In this instance the straw is bent near its outer end and does not have two telescoping sections as disclosed in my patent.

SUMMARY OF THE INVENTION

A straw assembly in accordance with the present invention includes telescoping inner and outer straws which may be placed in a container in a retracted position. Upon opening the container, the straw assembly automatically deploys to extend the inner straw through the opening in the container.

The inner straw has a flared first end, an opposite second end and a circular groove or other fastening mechanism disposed between the two ends and preferably closer to the second end. The outer straw is a one piece unitary member having a tubular portion extending between a first end and a bevel. The tubular portion concentrically receives the flared end of the inner straw in sealing, sliding relationship. The outer straw has a second end opposite the first end that is secured to the inner straw by a protrusion that mates with the groove or by another suitable fastening technique. A spring mechanism, preferably in the form of an integral helical spring connects the second end of the outer straw to the tubular portion. The spring mechanism biases the second end of the outer straw and hence the inner straw toward a deployed position in which the flared end of the inner straw engages the bevel of the tubular portion of the outer straw when the container is opened. Before the container is opened the inner straw is forced into a retracted position as the flared end of the inner straw slides within the tubular portion to the first end of the outer straw. A spring retainer cap may be advantageously used to secure the spring to the inner straw.

BRIEF DESCRIPTION OF THE DRAWINGS

A better understanding of the invention may be had from a consideration of the following Detailed Description, taken in conjunction with the accompanying drawings in which.

DETAILED DESCRIPTION OF THE INVENTION

Figure 1:
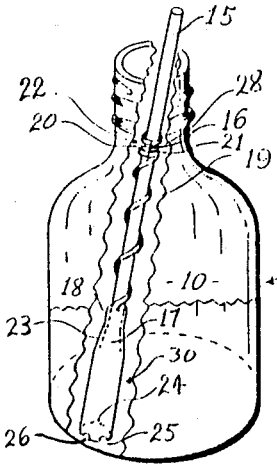
FIG. 1 is a perspective view of a conventional beverage bottle associates with the novel telescoping straw assembly incorporating the spirit of this invention and shows that the half of beverages in the beverage container has been drunk.
Figure 9:
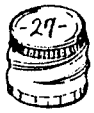
FIG. 9 is a perspective view of the cap of a conventional beverage bottle.
Figure 10:
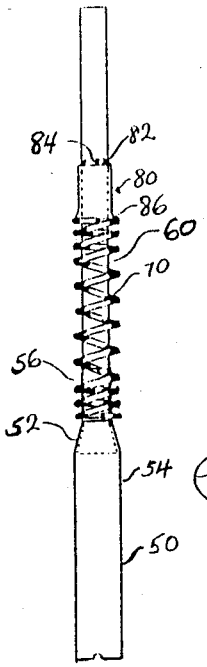
FIG. 10 is a plan view of an alternative embodiment of the invention.

Referring now to the drawings in detail, it will be seen that there is illustrated in FIG. 1 a conventional beverage bottle which is generally referred to by the numeral 11 and which is particularly for providing beverages by means of the novel telescoping double straw assembly 14. The bottle 11 is formed of a conventional bottle body 10 which has the top end portion provided with a twist open cap 27 as shown in FIG. 9.

In accordance with this invention, the novel telescoping straw assembly 14 consists of an inner straw 12 and an outer straw 13. When the cap 27 is twisted and opened up, the novel straw assembly 14, which has been already stored in the associated beverage container 11, is popped up by expansion of a coil spring mechanism 19 so that a person can drink the beverage through the top portion 15 of inner straw 12. In addition to the foregoing, if drinking of the beverage is not necessarily completed, the top portion 15 of inner straw 12 is simply pushed down by means of cap 27 and the cap 27 is put back on. It is to be understood that the novel telescoping straw assembly 14 can be used for other types of beverage containers such as plastic beverage containers or can type beverage containers.

Figure 2:
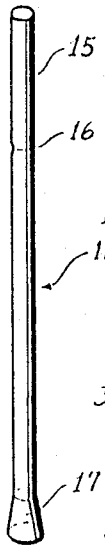
FIG. 2 is a fragmentary perspective view of inner straw of the novel double straw assembly.
Figure 3:
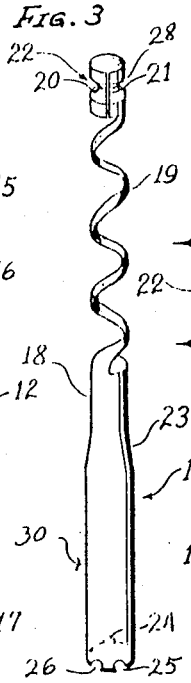
FIG. 3 is a fragmentary perspective view of the feinner straw accompanied with coil spring and with upper portion of securing inner straw.
Figure 4:
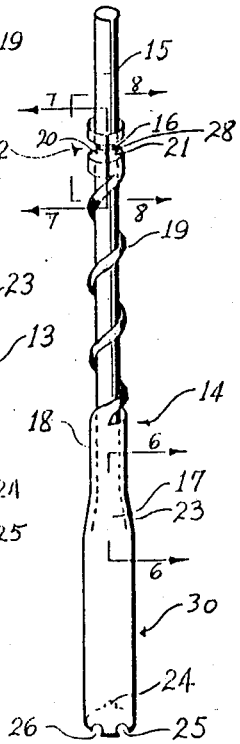
FIG. 4 is a perspective view of a novel double straw assembly.

Referring now to FIGS. 2 through 4, in particular, it will be seen that the inner straw 12 has a circular groove 16 and a flared portion 17. The outer straw 13 has the clamping device 22 at the top portion of outer straw 13, a coil spring 19, a tubular portion 30 adjacent the lower end and three half moon shaped holes 24, 25, and 26 at the bottom end of outer straw 13. The tubular portion 30 ends in a funnel portion or bevel 23 as shown in the lower middle portion of outer straw 13. It is to be noted, in accordance with this invention, that the secured end of outer straw 13 has vertically cut portions 20 and 21 which may be opened wider to facilitate assembly of inner straw 12 and outer straw 13. After the completion of the assembly process, the circular fastening protrusion 28 of clamping device 22 of outer straw 13 clamps to the grooved portion 16 of inner straw 12.

In accordance with this present invention, the particularly outer surfaces of the flare 17 of the inner straw 12 and inner surfaces of the bevel 23 of the outer straw 13 are very important in this invention. After inner straw 12 is secured to outer straw 13, as shown in FIG. 4, the outer surfaces of flare portion 17 of inner straw 12 slidingly and sealingly engage the inner surfaces of tubular portion 30 and bevel 23 of outer straw 13 in response to the force of the coil spring 19. Consequently beverage liquids are prevented from passing through between the outer surfaces of flare 17 of inner straw 12 and the inner surface of tubular portion 30 of the outer straw 13.

It is also to be noted that the engagement of flare 17 and bevel 23 operate to retain inner straw 12 concentrically within outer straw 13 and oppose the force of coil spring 19. Therefore a person can drink beverages by means of the novel telescoping straw assembly 14 without allowing any of the beverage liquid to pass through between the outer surface of inner straw 12 and the inner surface of outer straw 13.

Figure 8:
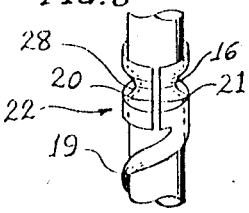
FIG. 8 is an enlarged fragmentary perspective view taken along the line 8—8 of FIG. 4.

It is to be understood that the clamping device 22 secures the inner straw 12 by mating the grooved portion 16 of inner straw 12 and the other protruding portion 28 of the clamping device 22 of outer straw 13 after completion of assembly as shown in FIG. 8.

Figure 5:
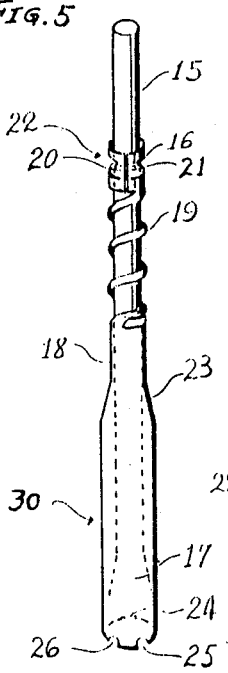
FIG. 5 is a perspective view of shorter novel double straw assembly than the one identified in FIG. 4.

As shown in FIG. 5 the bottom end of outer straw 13 has three half moon shaped holes 24, 25, and 26 through which the beverage liquids are taken up along the novel double straw assembly 14.

Referring now to FIG. 5, it will be seen that the inner straw 12 is secured by clamping device 22, has been pressed down to the retracted position having the coil spring 19 shorter than in the extended or deployed position as shown in FIG. 4. The flare 17 at the bottom end of inner straw 12 has been forced down closer to the bottom end of outer straw 13.

Figure 6:
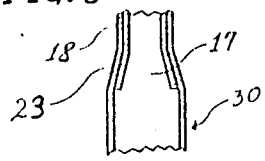
FIG. 6 is an enlarged fragmentary vertical sectional view taken along the line 6—6 of FIG. 4.

Referring now to FIG. 6, in more detail, it will be seen from the enlarged fragmentary vertical sectional view that the outer surfaces of flare 17 of inner straw 12 and the inner surfaces of bevel 23 of outer straw 13, and other upper part of outer surfaces of inner straw 12 and other upper part of the inner surfaces of the upper portion 18 of outer straw 13 are contacted together after the inner straw 12 is popped up or deployed by the force of coil spring 21. Consequently, beverage liquids are prevented from passing through between the described surfaces in the foregoing.

Figure 7:
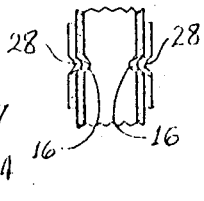
FIG. 7 is an enlarged fragmentary vertical sectional view taken along the line 7—7 of FIG. 4.

Referring now to FIG. 7 in more detail, it will be seen from the enlarged fragmentary vertical sectional view that the clamping device 22 of outer straw 13 is secured to inner straw 12 by mating groove portion 16 of inner straw 12 with the protruding portion 28 of outer straw 13.

Referring now to FIG. 8 in more detail, it will be seen from the enlarged perspective view that as clamping device 22 secures inner straw 12 thereof, both vertically cut portions 20 and 21 will be opened wider when the outer straw 13 receives inner straw 12 during the assembly process.

Figure 11:
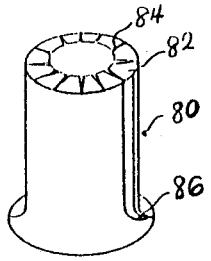
FIG. 11 is a perspective view of a spring retainer cap used in the embodiment shown in FIG. 10.
Figure 12:
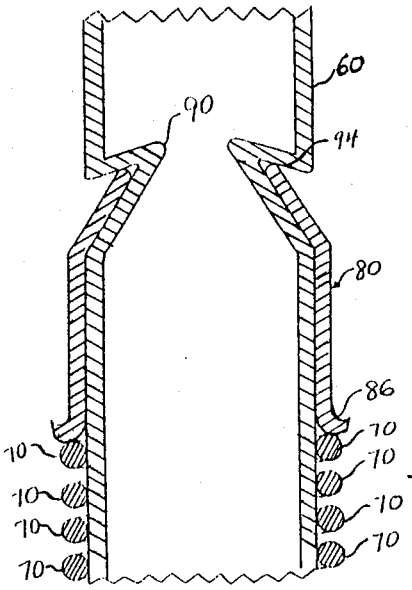
FIG. 12 is an enlarged, partly broken away sectional view illustrating in greater detail the embodiment shown in FIG. 10.

An alternative arrangement of a straw assembly in accordance with the invention is shown in FIGS. 11–12. An outer straw 50 has a shoulder 52 separating a larger diameter portion 54 from a smaller diameter neck portion 56.

Outer straw 50 slidably receives an inner straw 60 as inner straw 60 is inserted into outer straw 50 through the bottom and has a flared bottom end 62 which engages shoulder 52 to prevent inner straw 60 from passing completely through outer straw 50.

A helical spiral expansion spring 70, is concentrically received by neck portion 56 of outer straw 50 and by inner straw 60. A lower end of spring 70 engages and is supported by shoulder 52 while an upper end engages and is supported in compression by a spring retainer cap 80.

Cap 80 has a generally cylindrical construction with an inner diameter slightly larger than the outer diameter of inner straw 60. Cap 80 has a top flange 82 extending radially inward and preferably formed by crimping inwardly an upper portion of the cylindrical sidewall of cap 80. The flange 82 remains resiliently bent substantially 90 degrees radially inward and has a central axial bore with a diameter slightly smaller than the outer diameter of inner straw 60. Flange 82 may have radially extending notches 84 cut or otherwise formed therein to reduce bunching or folding as flange 82 is formed radially inward.

The engagement between cap 80 and inner straw 60 is shown in greater detail in FIG. 12. Inner straw 60 has a groove 90 near the upper end thereof but spaced from the end a sufficient distance to allow engagement of the end by a user's mouth in the usual manner. The radially inward groove 90 extends circumferentially around inner straw 60 and preferably presents a surface 94 which extends upwardly and inwardly. Groove 90 provides a notch for receiving the inner circumference of flange 82. A locking relationship is formed to prevent upward movement of cap 80 after flange 82 engages groove 90 by making the inner diameter of flange 82 slightly larger than the outer diameter of the smallest portion of groove 90. Cap 80 has a flared end 86 opposite the flanged end 82. Flared end 86 receives and retains the upper end of expansion spring 70.

For easy assembly the inner straw 60 is inserted through the bottom of outer straw 50 and spring 70 is seated against shoulder 52. The retainer cap 80 is then slid over the upper end of inner straw 60 until the flange 82 engages and is received by groove 90. The inner straw 60 may then be retracted or deployed relative to outer straw 50 but remains biased by spring 70 toward the deployed position.

Although a particular straw assembly according to this invention has been illustrated and described for the purpose of enabling a person skilled in the art to made and use this invention, other embodiments may be employed without departing from the spirit and scope of the invention. Accordingly, any modifications, variations or equivalent arrangements within the scope of the attached claims should be considered to be within the scope of the present invention.

What is claimed is:

1. A telescoping straw assembly comprising:

an inner straw having a flared first end and an opposite second end; and a one piece unitary outer straw having a tubular portion extending between a first end and a bevel, the tubular portion concentrically receiving the flared end of the inner straw in sliding relationship, the outer straw further having a second end opposite the first end that is secured to the inner straw and a spring mechanism connecting the second end to the tubular portion such that the straw assembly is biased toward a deployed position in which the flared first end of the inner straw engages the bevel of the tubular portion of the outer straw and may be moved in response to an external force to a retracted position in which the flared end of the inner straw is closer to the first end of the outer straw than in the deployed position, the spring mechanism being formed as a helical spring that concentrically receives the inner straw.

2. A straw assembly according to claim 1 wherein the inner straw has a circular groove disposed between the first and second ends and the second end of the outer straw has a circular protrusion which matingly engages the groove of the inner straw to secure the second end of the outer straw to the inner straw.

3. A straw assembly according to claim 1 wherein the outer straw has at least one hole through the wall thereof at the first end.

4. A container assembly comprising:

a container having an opening closed by a cap member;

an inner straw disposed within the container and having a flared first end and an opposite second end; and a one piece unitary outer straw disposed within the container and having a tubular portion extending between a first end and a bevel, the tubular portion concentrically receiving the flared end of the inner straw in sliding relationship, the outer straw further having a second end opposite the first end that is secured to the inner straw and a spring mechanism connecting the second end to the tubular portion, the flared end of the inner straw being retracted within the tubular portion of the outer straw and being biased toward an extended position by the spring mechanism such that upon removal of the cap member from the container the inner straw is telescopingly extended through the opening of the container, the spring mechanism being formed as a helical spring that concentrically receives the inner straw.

5. A telescoping straw assembly comprising:

an inner straw having a tubular body extending between a flared first end and an opposite second end and a circumferentially extending radially inward groove disposed between the first and second ends;

a generally cylindrical spring retainer cap disposed concentrically about the inner straw with an outwardly flared first end directed toward the first end of the inner straw and a radially inward extending flange at an opposite second end, the flange matingly engaging the groove in the inner straw to restrain the cap from moving toward the second end of the inner straw;

an outer straw having a first end receiving the flared end of the inner straw and a smaller diameter opposite second end receiving the body of the inner straw in sliding relationship, the outer straw having a shoulder portion which provides a transition between the larger diameter first end and the smaller diameter second end and limits motion of the inner straw upon engagement with the second flared end thereof; and a helical coiled spring mounted in compression concentrically about the inner and outer straws with one end seated against the shoulder of the outer straw and the other end seated against the flared end of the spring retainer cap to urge the inner straw toward engagement of the flared end thereof with the shoulder of the outer straw.

* * * * *